United States Patent [19]

Rogers, Jr.

[11] 4,048,680

[45] Sept. 20, 1977

[54] SOFA BED AND LINKAGE MECHANISM

[75] Inventor: Walter Clark Rogers, Jr., Denton, N.C.

[73] Assignee: Royal Development Company, Inc., High Point, N.C.

[21] Appl. No.: 723,159

[22] Filed: Sept. 14, 1976

[51] Int. Cl.[2] ..... A47C 17/10; A47C 17/14

[52] U.S. Cl. ..... 5/37 R; 5/47; 5/12 R; 5/57 R

[58] Field of Search ..... 5/12, 14, 17, 18, 37 R, 5/47, 57 R; 297/63–67, 342

[56] References Cited

U.S. PATENT DOCUMENTS

| | | | |
|---|---|---|---|
| 2,028,426 | 1/1936 | Wunderlich | 5/47 |
| 2,601,683 | 7/1952 | Befry et al. | 5/47 |
| 2,672,625 | 3/1954 | Rhodes et al. | 5/47 |

*Primary Examiner*—Casmir A. Nunberg
*Attorney, Agent, or Firm*—William E. Mouzavires

[57] ABSTRACT

A sofa bed including a seat and back pivotally connected to each other and mounted to a stationary base by means of a five-bar linkage located at opposite sides of the sofa bed. In the "bed position," the five-bar linkage is in an open or expanded state with the seat and back extending in coplanar relationship in horizontal plane parallel to and above the base. In the "sofa position," the five-bar linkage is closed or collapsed and the seat extends in a horizontal plane and the back extends in an upright inclined position. To actuate the sofa bed between said positions, the seat is grasped at a forward edge portion and slightly raised which activates a second linkage, namely a four-bar linkage, which actuates and controls the five-bar linkage while permitting it to either open or close depending upon the position of the sofa bed to be achieved. The four-bar linkage includes a link in the form of a crank pivotally connected at one end to the seat and a second link having one end pivotally connected to the opposite end of the crank and an intermediate portion pivotally connected to an intermediate portion of one of the links of the five-bar linkage which also forms one of the links of the four-bar linkage. Stop means are provided for limiting and defining both positions of the sofa bed.

14 Claims, 8 Drawing Figures

SOFA BED AND LINKAGE MECHANISM

BACKGROUND OF INVENTION

The present invention generally relates to sofa beds and more particularly to a new and improved sofa bed as well as a linkage mechanism incorporated therein for moving it between sofa and bed positions. The sofa bed is of the type which includes a seat and a back which, in the bed position of the sofa bed, are in horizontal coplanar interrelationship, and in the sofa position extended at an angle to each other with the seat extending in a horizontal plane and the back extending in a generally upright position relative to the seat.

It is an object of the present invention to provide an improved sofa bed which may be quickly and easily converted from a sofa to a bed and vice versa with little effort and, at the same time, may be designed to meet the present day styling requirements. Included herein is the provision of such a sofa bed which may be placed adjacent a wall in a room but will not strike the wall when moving from the sofa position to the bed position.

A further object of the present invention is to provide a relatively simple but novel linkage system for mounting the seat and back of the sofa bed relative to an underlying base for providing the occupant's support as well as the movement of the seat and back between the sofa and bed positions. Included herein is such a linkage system having a minimum of parts which may be easily fabricated and incorporated into standard or conventional sofa bed frame structures and upholstery.

DRAWINGS

Other objects and advantages of the present invention will become apparent from the following more detailed description taken in conjunction with the drawings in which.

DETAILED DESCRIPTION

Figures 1, 1A:
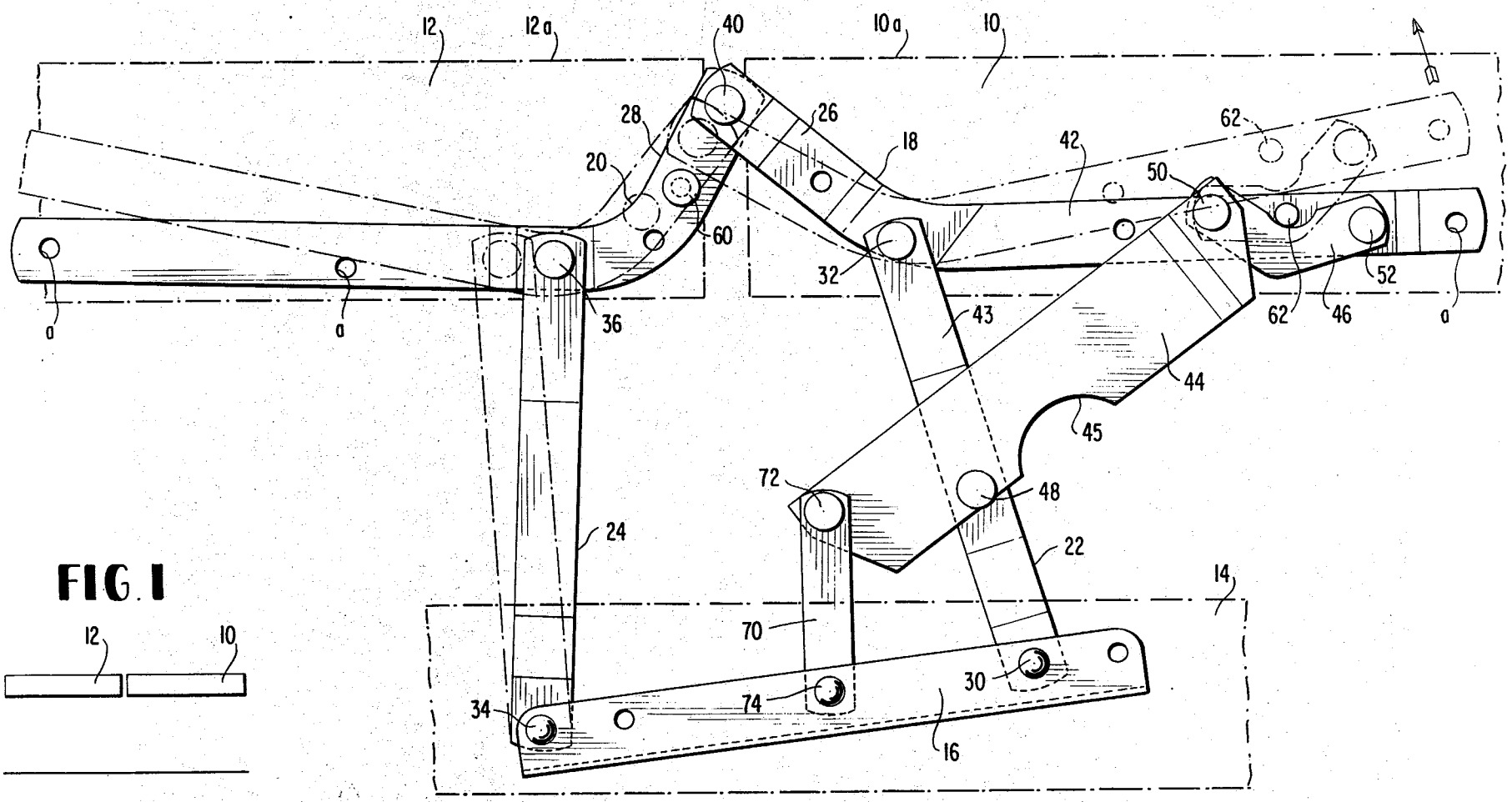
FIG. 1 is a schematic view of the seat and back of a sofa bed of the present invention shown in the bed position.
FIG. 1A is an elevational, side view of the sofa bed constituting a preferred embodiment of the present invention and particularly showing the linkage system and the sofa bed in the bed position, and with the seat, back and base portions of the sofa bed being broken away and shown in phantom.
Figures 2, 2A:
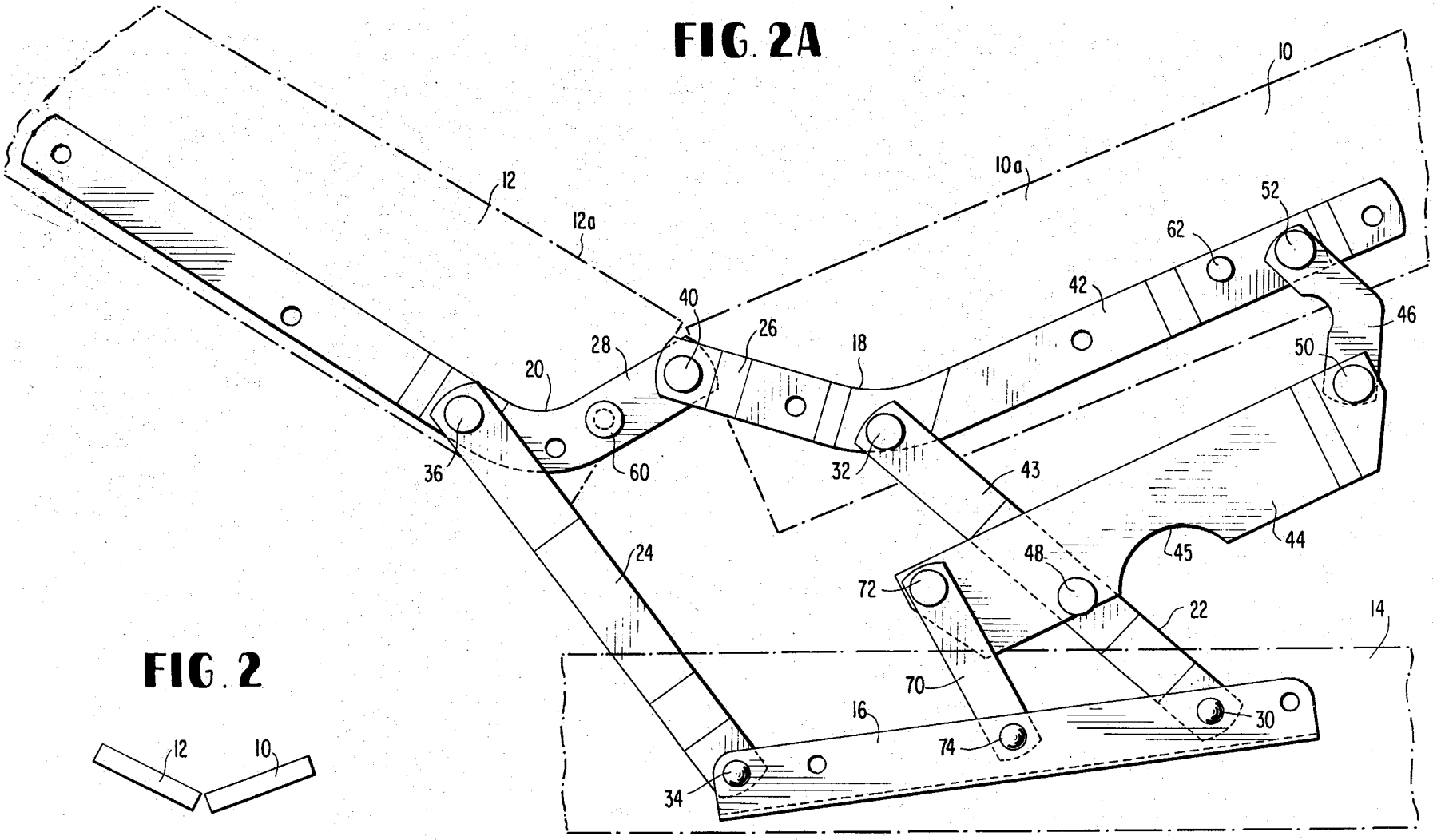
FIG. 2 is a view similar to FIG. 1 but showing the seat and back in a position intermediate the sofa position and the bed position during movement between these positions.
FIG. 2A is a view similar to FIG. 1A but with the sofa bed parts shown in the intermediate position of FIG. 2.
Figures 3, 3A, 4, 5:
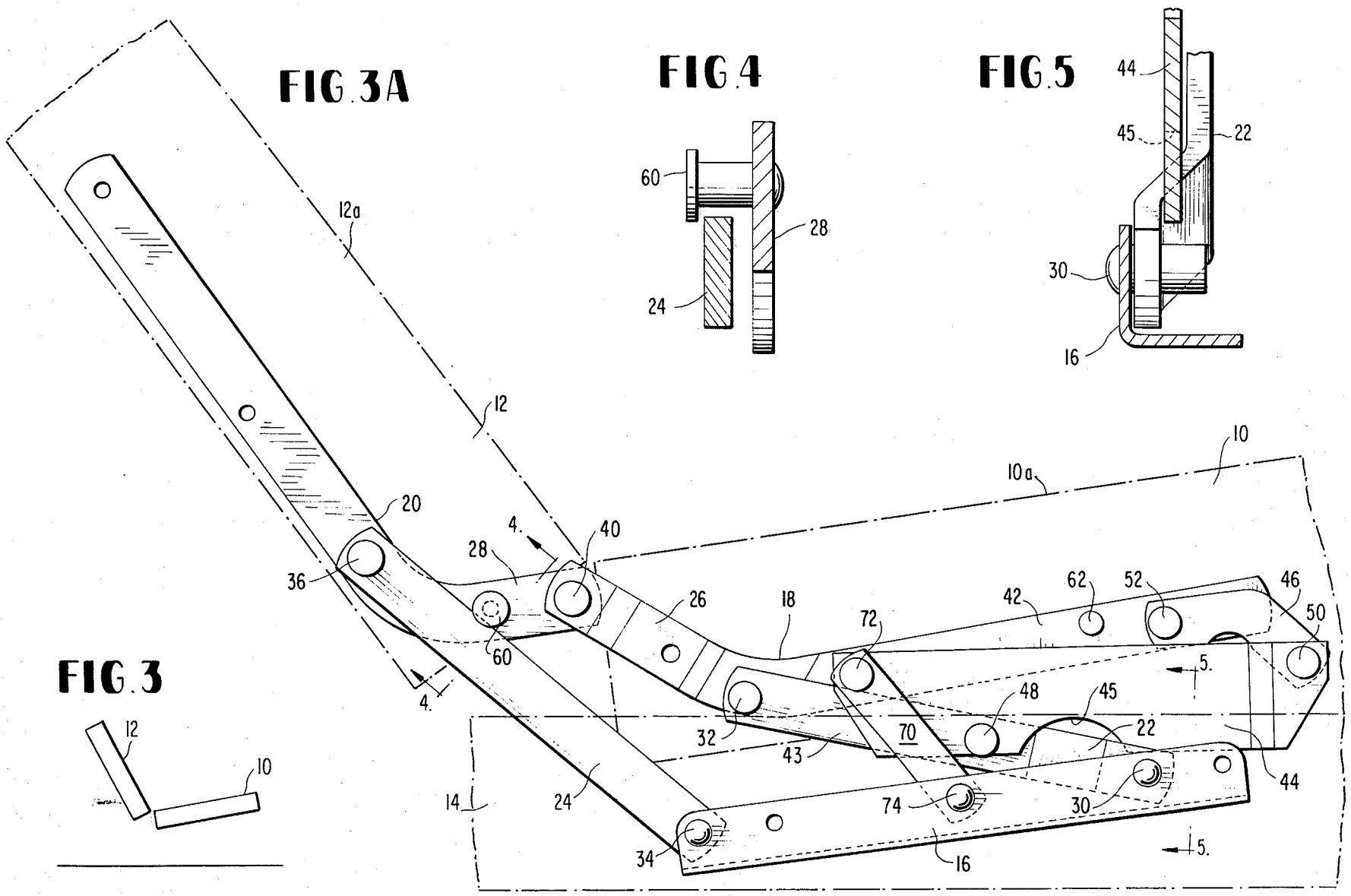
FIG. 3 is a view similar to FIG. 2 but with the seat and back shown in the sofa position.
FIG. 3A is a view similar to FIG. 2A but with the parts shown in a position when the sofa bed is in the sofa position of FIG. 3.
FIG. 4 is an enlarged, fragmental, cross-sectional view taken generally along lines 4—4 of FIG. 3A.
FIG. 5 is an enlarged, fragmental, cross-sectional view taken generally along line 5—5 of FIG. 3A.

Referring now to the drawings in detail, there is shown for illustrative purposes, a sofa bed constituting a preferred embodiment of the present invention. Initially with reference to FIG. 1, the sofa bed includes a seat generally designated 10, a back generally designated 12, and a base generally designated 14. Seat 10 always remains in a generally horizontal plane (at two different elevations depending on whether it is in the sofa or bed position), it being understood that the seat is the portion of the sofa bed upon which one sits when in the sofa bed position. Back 12 has two use positions, one being a horizontal position coplanar with the seat 10 when in the bed position (when the sofa bed is being used as a bed), and the other position being a generally upright position which, in the preferred embodiment, is at an angle extending upwardly and rearwardly from seat 10 (when the sofa bed is being used as a sofa). The positions of seat 10 and back 12 when in the bed position are shown in FIG. 1 whereas, the positions of these parts when in the sofa position, are shown in FIG. 3. FIG. 2 shows the position of the parts in an intermediate position which is reached during movement between the sofa and bed positions.

Seat 10 and back 12 may include any conventional wood or metallic frames, and upholstery designated **10*a* and 12*a*; and further description of these parts is not deemed to be necessary as they form no part of the present invention. The same is true with respect to the base 14, that is, any suitable base structure may be utilized, however, it should be understood that base 14 remains stationary at all times during movement of the seat 10 and back 12** between the bed and sofa positions.

In accordance with the present invention, a novel linkage system is provided for mounting seat 10 and back 12 relative to each other and also relative to base 14 for movement between the bed and sofa positions. The linkage system includes identical linkages on opposite sides of the sofa bed and therefore only one linkage system at one side of the bed need be shown and described.

The linkage system of the preferred embodiment of the invention includes a five-bar linkage comprised of links 16, 18, 20, 22 and 24. Link 16 may be termed a "frame link" as it is fixed as by screws or other suitable fasteners (not shown) extending through apertures *a* to a base frame 14. Link 26 may be termed a "seat link" as it is rigidly fixed to the rear portion of seat 10. Similarly, link 28 may be termed a "back link" since it is rigidly fixed to a forward portion of back 12 as shown in FIG. 1A. During movement of the sofa bed between the sofa and bed positions, it will be understood that the frame link 16 remains stationary, however, seat and back links 26 and 28 move together with the seat 10 and back 12 respectively as they are rigidly secured to these parts as described. Link 22 may be termed a "seat mounting link" since it serves to mount seat 10 for pivotal or swinging movement relative to base frame 14. Similarly, link 24 may be termed a "back mounting link" since it serves to similarly mount the back to base frame 14. Seat mounting link 22 is pivotally mounted at its lower end by pivot 30 to base frame link 16, and its upper end is pivotally connected to seat link 26 by pivot 32. Back mounting link 24 is pivotally mounted by pivot 34 at its lower end to base frame link 16, and its upper end is pivotally connected to back link 20 by pivot 36. Seat and back links 26 and 28 are pivotally connected at their extremities to each other by means of pivot 40. As will become clearer from the description below, links 22, 24, 26 and 28 of the five-bar linkage are capable of moving in vertical plane relative to each other as well as the base frame link 16.

With reference to FIG. 1A, it will be seen that the geometry of this five-bar linkage is such that when the sofa bed is in the bed position, back mounting link 24 will extend in generally upright or vertical positions while converging away from base frame link 16 with seat mounting link 22 being included to a greater degree than back mounting link 24. In addition, seat and back links 26, 28 will form a generally inverted V-shaped configuration. In the sofa position of the sofa bed, as shown in FIG. 3A, the five-bar linkage will be in a relatively collapsed or closed position with seat and back mounting links 22 and 24 extending rearwardly from base 14 but with seat mounting link 22 extending at a lesser angle to the horizontal than back mounting link 24.

Actuation of the sofa bed between its use positions is achieved through what may be termed, for purposes of description, as a "four-bar linkage" including a seat link 42; a link 43 which constitutes the upper portion of seat mounting link 22 extending between pivots 48 and 32; link 44; and link 46. Link 42 is rigidly fixed to the seat and in the specific embodiment shown, is formed as an integral part of seat link 26. Link 46 in the preferred embodiment is a small crank pivotally connected at one end by pivot 52 to seat link 42 and at its opposite end by pivot 50 to the forward end portion of link 44. Link 44 is pivotally connected by pivot 48 to an intermediate portion of seat mounting link 22. When the sofa bed is in the bed position, the position of this four-bar linkage is as clearly indicated in FIG. 1A. When it is desired to move the sofa bed into the sofa position, the front portion of seat 10 is slightly raised which causes the back link 20 and consequently back 12 to swing forwardly in a clockwise direction as viewed in FIGS. 1A and 2A by virtue of seat links 42 and 26 which serve to transmit motion from the raised seat 10 to the back link 20 and in turn the back 12. The initial phase of such movement is shown in phantom lines in FIG. 1A where it is seen that both the seat link 42 and crank 46 have been pivoted upwardly in a counterclockwise direction (about pivots 32 and 50 respectively) by virtue of the raising of seat 10. After crank 46 reaches the position shown in phantom lines in FIG. 1A, the seat may be easily moved rearwardly which will cause the five-bar linkage including the seat and back mounting links 22 and 24 to swing rearwardly in a counterclockwise direction (about pivots 30, 34) as the back 12 swings upwardly in a clockwise direction until the sofa position is reached as shown in FIG. 3A. Thus, rearward movement of the five-bar linkage is easily achieved through the weight of the sofa bed, the center of gravity of which is shifted rearwardly once the seat is raised slightly to position link 46 as shown by the phantom lines in FIG. 1A. FIG. 2A clearly shows how the weight of the sofa bed will easily cause the five-bar linkage to swing rearwardly to collapsed or closed position shown in FIG. 3A.

Movement of the back to the sofa position is limited by stop means in the form of a stud 60 which may be fixed to the back link 28 so as to engage back mounting link 24 when the back is moved to the sofa position shown in FIG. 3A. Movement of the four-bar actuating linkage to the sofa position is finally limited by means of link 70 pivoted at its lower end by pivot 74 to the base frame link 16 and at its upper end by pivot 72 to the rear end portion of link 44. In order to accommodate frame link 16 in the specific embodiment, link 44 is formed with a cutout portion 45 so as to avoid obstruction by seat mounting link 22 when the parts are in the sofa position shown in FIG. 3A.

Referring to FIG. 1A, when the sofa bed is in the bed position, downward movement of seat 10 and seat link 42 is prevented by means of engagement of a stop in the form of a stud 62 against crank 46. Stop 62 is fixed to seat link 42. In addition, pressure on the seat 10 in a horizontal plane directed rearwardly also will not open the four-bar linkage because pivot 52 is in general horizontal alignment with pivot 50 but preferably located below pivot 50 so that any horizontal forces would be resisted by link 44. However, when the seat 10 is initially raised as indicated by the arrow in FIG. 1A to the point where pivot 52 is raised to a certain degree above pivot 50, a slight horizontal force applied to seat 10 and greatly assisted by the weight of the linkage and bed as described above will cause the four-bar linkage 42, 43, 44 and 46 to open (one of the open positions being shown in FIG. 2) to cause the seat and back mounting links 22 and 24 to swing rearwardly in a counterclock wise fashion shown in FIGS. 2A and 3A until the sofa position is achieved as shown in FIG. 3A. It will therefore be seen that seat link 42 serves as a primary actuating link deriving its driving force from the initial raising of seat 10. In addition, links 44 and 46 serve as restraining and control linkage.

In order to move the sofa bed from the sofa position shown in FIG. 3A to the bed position shown in FIG. 1A, again the front of seat 10 is raised which will open the four-bar linkage and cause the five-bar linkage to swing forwardly with the back and seat mounting links 22 and 24 swinging in clockwise direction about pivots 30 and 34. This will elevate and project forwardly seat 10 while also projecting back 12 forwardly as it moves into a horizontal position coplanar with seat 10. This forward movement of the seat and back enables the sofa bed to be placed adjacent a wall in a room without the back 12 striking the wall when the sofa bed is moved into the bed position.

Although one specific angular relationship of the seat and back relative to each other and the horizontal has been shown, it should be understood that this may be varied by changing the position of the seat and back links 42, 26 and 20, 28 relative to the seat and back frames and also by changing the angle between seat link portions 26 and 42; and between back link 28 and the remaining portion that extends at an angle thereto along the back frame 12.

What is claimed is:

1. A sofa bed comprising in combination a base, a seat, and a back, first linkage means interconnecting the back and seat mounting them relative to the base for movement relative to each other between a sofa position wherein the seat extends generally in a horizontal plane and the back extends generally in upright position from the rear of the seat, and a bed position wherein the back and seat extend in coplanar horizontal relationship, and second linkage means including a link fixed to the seat to be movable therewith for actuating the first linkage means to move the sofa bed between said sofa and bed positions upon initial raising of a forward portion of the seat, and wherein said first linkage means includes a seat link fixed to the seat to be movable therewith, a back link fixed to the back to be movable therewith, a seat mounting link having an upper end portion pivotally connected to the seat link and a lower end portion pivotally mounted to the base, a back mounting link having an upper end portion pivotally connected to the back link and a lower end portion pivotally mounted to the base, and wherein said second linkage means includes a control linkage having one end portion pivoted to said seat link and another end portion pivoted to said seat mounting link whereby the seat link must be raised relative to the base to actuate the control linkage to permit the sofa bed to be moved to either the sofa or bed position.

2. The sofa bed defined in claim 1 wherein said first linkage means includes a five-bar linkage and wherein said second linkage means includes a four-bar linkage.

3. The sofa bed defined in claim 1 wherein said control linkage includes two control links, the first control link being pivotally connected to the seat link and the second control link being pivotally connected to the seat mounting link and the first and second control links being pivotally connected to each other.

4. The sofa bed defined in claim 3 including a stop link having one end pivotally connected to the base and having another end pivotally connected to the second control link.

5. The sofa bed defined in claim 4 including a stop fixed relative to the seat and engageable with said first control link when the sofa bed is in the bed position.

6. The sofa bed defined in claim 5 including a second stop fixed relative to the back and engageable with the back mounting link when the sofa bed is in the sofa position.

7. The improvement defined in claim 3 wherein when the sofa bed is in the bed position and the seat is initially raised to move the sofa bed into sofa position, the seat link pivots about the seat mounting link carrying with it and pivoting upwardly the first control link and during continued movement the second control link is moved away from the seat the link by the first control link while the seat and back mounting links swing rearwardly relative to the base towards collapsed condition under the weight of the sofa bed, the center of gravity of which has been shifted, to assist movement of the sofa bed to the bed position.

8. A linkage system for a sofa bed of the type including a fixed base, a seat and back movble relative to each other as well as the base; the linkage system comprising in combination, a seat link and a back link pivotally connected to each other and adapted to be fixed respectively to the seat and the back of a sofa bed with the pivotal connection between the seat and back link located between the seat and back, a seat mounting link having one end pivotally connected to the seat link and another end adapted to be pivotally connected to the base of a sofa bed, a back mounting link having one end pivotally connected to the back link and another end adapted to be pivotally connected to the base of a sofa bed, and a control linkage means for restraining the seat mounting link including a first control link pivotally connected to the seat link at a position forwardly of the pivotal connection of the seat mounting link to the seat link, and a second control link pivotally connected to the first control link and pivotally connected to the seat mounting link whereby the seat link must first be moved relative to the seat mounting link to actuate the control linkage means to free the linkage system to move between sofa and bed positions.

9. The linkage system defined in claim 8 further including a base link adapted to be mounted to the base of a sofa bed and wherein the seat and back mounting links are pivotally connected to the base link.

10. The linkage system defined in claim 9 further including a stop link pivotally connected to the second control link and pivotally connected to the base link and wherein the pivotal connection of the second control link to the seat mounting link lies between the pivotal connections of the second control link to the first control link and the stop link.

11. The linkage system defined in claim 10 including a stop fixed to the seat link to be engageable with said first control link when the linkage system is in a position for supporting the associated sofa bed in the bed position.

12. The linkage system defined in claim 11 further including a stop on the back link engageable with the back mounting link when the linkage system is in the position supporting the associated sofa bed in the sofa position.

13. The linkage system defined in claim 12 wherein said seat and back mounting links and said base link and portions of said seat and back links define a five-bar linkage which is open and adapted to support the sofa bed in the bed position and which collapses when the sofa bed is in the sofa position and wherein said first and second control links and portions of said seat link and said seat mounting link define a four-bar linkage which is generally closed when the five-bar linkage is in the open position and which opens during movement of the linkage between sofa and bed positions.

14. The linkage system defined in claim 12 wherein said five and four-bar linkages are arranged such that when the seat link is initially raised by pivoting about the seat mounting link, the first control link will pivot upwardly to space the second control link from the seat link to permit movement of the linkage system for converting the sofa bed between the sofa and bed positions.

* * * * *